US005553854A

United States Patent [19]

Rum

[11] Patent Number: 5,553,854

[45] Date of Patent: Sep. 10, 1996

[54] GAME BOARD GAME AND METHOD PLAYING THE GAME

[76] Inventor: Wojciech M. Rum, 57 Conselyea St., Brooklyn, N.Y. 11211

[21] Appl. No.: 406,008

[22] Filed: Mar. 16, 1995

[51] Int. Cl.[6] ..... A63F 3/00

[52] U.S. Cl. ..... 273/275; 273/267

[58] Field of Search ..... 273/282.1, 263, 273/264, 267, 271, 275, 276

[56] References Cited

U.S. PATENT DOCUMENTS

| | | | |
|---|---|---|---|
| 2,162,876 | 6/1939 | Barton | 273/275 |
| 3,695,615 | 10/1972 | Shoptaugh | 273/282.1 |
| 3,804,415 | 4/1974 | Ryan | 273/275 |
| 4,032,151 | 6/1977 | Morse | 273/275 |
| 4,074,907 | 2/1978 | Curtis | 273/282.1 |

*Primary Examiner*—Jessica J. Harrison

*Assistant Examiner*—William M. Pierce

*Attorney, Agent, or Firm*—Richard B. Klar

[57] ABSTRACT

The present invention relates to a board game and method of playing the game. The game involves a strategic means for defining paths along the game board. The game board is preferably configured as 9×9 lines, creating 64 squares with a black cross piece in the center. Each of the squares is raised, creating a recess therein in which pieces can be inserted. The inserted pieces include pawns and connector pieces. The connector pieces can either be I-shaped, L-shaped or T-shaped, or cross-shaped. Each player is provided with a set of pawns and connector elements as described above. The object of the game is to start at the center cross section, each player to continue with his pawn and connector piece, thereby defining the paths that the next player can take. The game is played until an opponent can move no further, or the opponent with the fewest pieces on hand at the end of the game wins.

19 Claims, 2 Drawing Sheets

GAME BOARD GAME AND METHOD PLAYING THE GAME

BACKGROUND OF THE INVENTION

1. Field of the Invention

The present invention relates to a game played with a game board and the method of playing the game. In particular the present invention relates to a game which provides a strategic challenge to players to define pathways which limit the movement of the other players so that at the end of the game the winning player has no pieces remaining. The purpose of the game is to get rid of as many pawns and connecting pieces and connectors or connecting pieces by putting paths and shapes on the board, and also by encircling an area so that the opponent's circled pieces are returned to him or her. In particular, the present invention is a game having a game board formed of 64 square grids. Each of these square grids is raised so as to form recesses between the square grids in which playing pieces can be inserted.

Pieces used in the game include rectangularly shaped pieces called "pawns" and connecting pieces, or connectors, having one of several shapes: cross shapes, I- shapes, L-shapes, and T-shapes. The purpose of the game is to define paths to be taken by each player. Players alternatively take turns placing their pawns followed by a connector. The game starts at the center, where a cross piece is located. The cross piece defines one of four possible paths which can be taken. A player must then insert a pawn near one of these paths defined by a cross shaped piece located in the center of the board, and after the pawn place one of the connectors. The next player must then continue along any of the paths that are available either from the centrally located cross piece or from one of the paths defined by the connector piece that the previous player had placed. In this way, the game provides a strategic challenge to players to define pathways which limit movement upon the other players so that at the end of the game the winning player has no pieces remaining. The purpose of the game is to get rid of as many pawns and connecting pieces by putting paths and shapes on the board, and also by encircling an area so that the opponent's circled pieces are returned to him or her.

2. The prior art

Board games are known in the prior art. One such board game is U.S. Pat. No. 2,162,876 to Barton. In this patent (the '876 patent), a board is provided with hollowed out squares and with square shaped pieces which fit into the hollowed squares and which have various configurations inscribed thereon. These inscriptions indicate directions of movement for subsequent players. This game is initiated at one of four middle points at the borders of the game board. The object of the game is that the game is played until only one player can move. This player is declared the winner (page 2, left hand column, lines 71–74). A player may reclaim pieces on the board and thus keep playing after six of his pieces on the board have been used (page 2, right-hand column, lines 9–12). This game does not teach using up pieces nor that the pieces used or played are both pawns and connectors to determine pathways, and thus is less complex, and does not require the degree of strategy as required by the present invention.

It would therefore desirable to provide a game board with pieces wherein a strategic game can be developed which provides for developing paths for encircling given fields or areas so that one or more opponent can be forced to reclaim his or her pieces, and that only the player who has encircled this field can place his pieces therein.

SUMMARY OF INVENTION

It is a principal object of the invention to provide a game board game and a method of playing the game, which avoids the aforementioned drawbacks of the prior art.

It is a further object of the invention to provide a game based upon strategy rather than chance, and in which paths for a player are determined by the prior players' placement of pieces, namely pawns and connectors, on the board.

Yet another object of the present invention is to provide game in which pawns and connectors can be placed within recesses formed by raised square grids.

Still another object of the present invention is to provide a game board with pieces for developing paths to encircle a given field or area thus forcing one or more opponents to reclaim his or her pieces from within the encircled field and only permit the player who encircled the field to place his or her pieces therein.

Other objects will become apparent from the foregoing description and drawings.

DETAILED DESCRIPTION OF THE PREFERRED EMBODIMENTS

Figure 1:
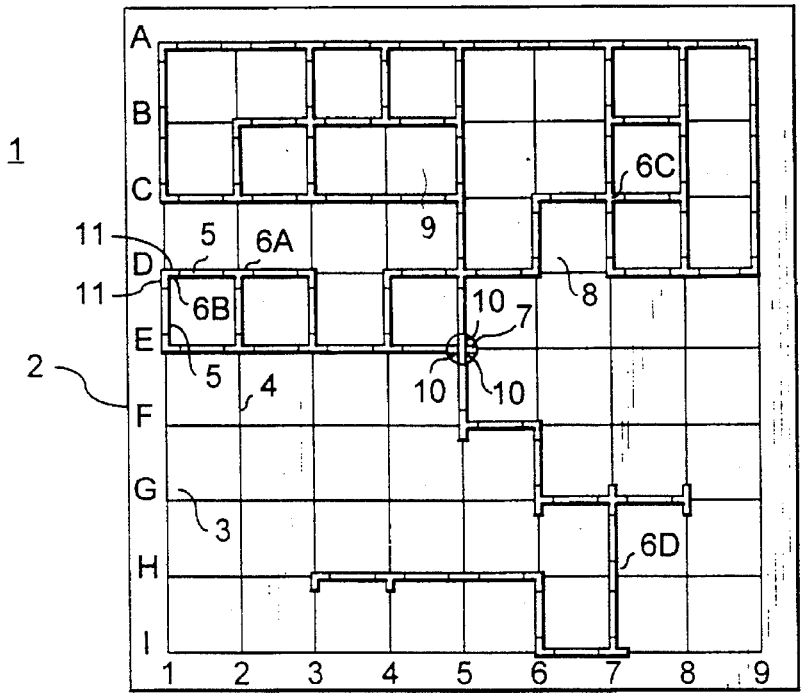
FIG. 1 is a top view of the board of the present invention in which certain paths have been chosen by pawns and connector elements in order to highlight possible patterns that can be taken in a game.
Figure 2:
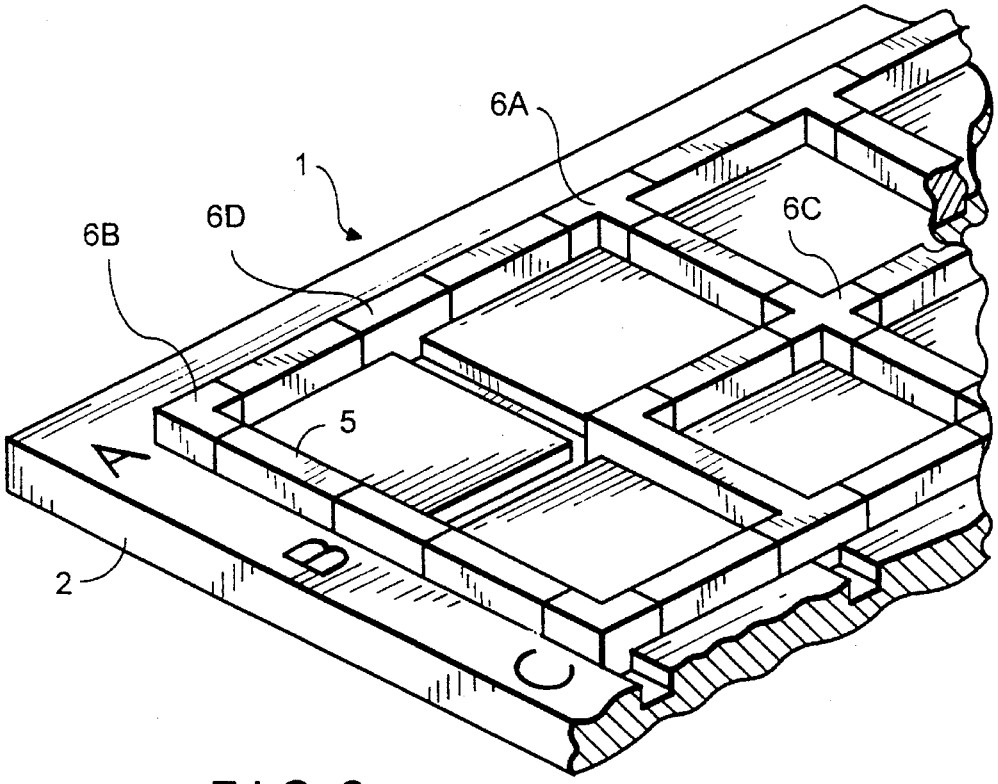
FIG. 2 is a partial perspective section of the board in FIG. 1 showing the placement of the pawns and connectors within the recesses between the raised squares on the grid block.
Figure 3:
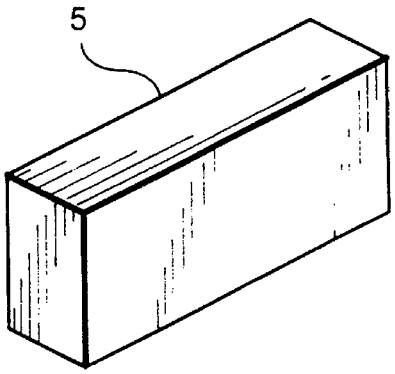
FIG. 3 is a perspective view of a pawn on the present invention.

Reference is now made to drawings in FIGS. 1 through 8 wherein FIG. 1 shows the game board for the game 1. The game board 2 is preferably configured as a square grid formed by 9×9 lines into 64 squares. Each square 3 is raised so that a recess 4 is formed between the squares 3, permitting the insertion of pieces by players during the game 1. These pieces include pawns 5 (FIG. 3) which are preferably rectangularly shaped, and connectors 6 (FIGS. 4–7). Connectors 6 can have one of several shapes, as is best shown in FIGS. 4 through 7.

Figure 4:
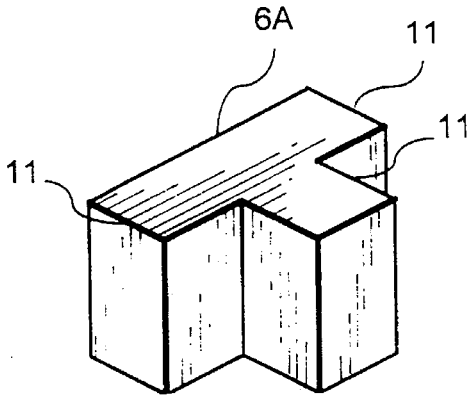
FIG. 4 is a perspective view of a T-shaped connector.
Figure 5:
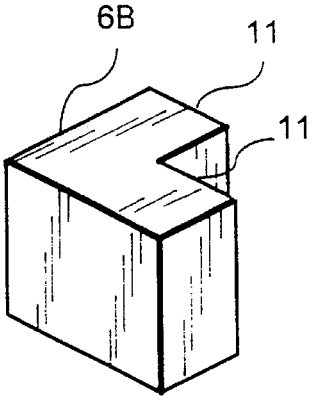
FIG. 5 is an L-shaped connector for the present invention.
Figure 6:
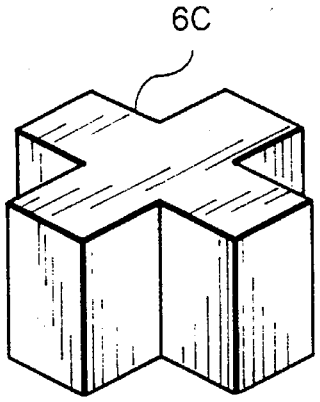
FIG. 6 is a cross-shaped connector.
Figure 7:
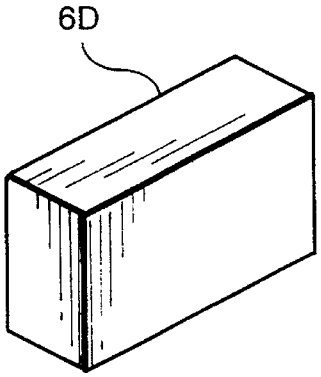
FIG. 7 is an I-shaped connector.
Figure 8:
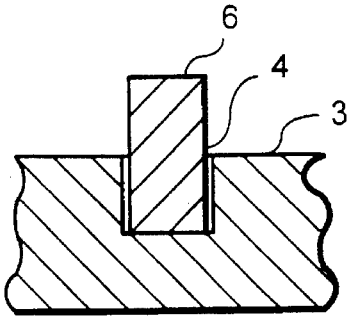
FIG. 8 shows the insertion of one of the connectors pieces within a recess in the game board in partial view.

FIG. 4 shows a T-shaped connector 6A. FIG. 5 shows an L-shaped connector 6B. FIG. 6 shows a cross-shaped connector 6C. FIG. 7 shows an I-shaped connector 6D. FIG. 8 shows the insertion of a portion of a connector 6 into a recess 4 between the squares 4 on the game board 2.

As shown in FIG. 1, the center portion of the game has between the recessed areas of the center a cross piece 7. The game 1 is initially played or starts at this location. Each pawn 5 must be placed with a chosen connector 6, except when joining two open ends of the connectors 6 that are already on the board 2. In a preferred embodiment for two players the game 1 includes the following two sets of game pieces: 52 pawns 5, preferably colored red and green; 3 cross-shaped connectors 6 colored yellow; 6 I-shaped connectors 6D colored yellow; 12 L-shaped connectors 6B and 18 T-shaped connectors 6A for each of the connectors 6, preferably colored yellow. It is understood that the number of game pieces sets and players may vary and also that the game board 2 if desired can be changed to a larger size with more than sixty four squares 3 without departing from the scope of the claimed invention.

The object of the game 1 is that the player with less pawns on hand at the conclusion of the game wins. Each player places his pawns 5 with the connectors 6 on the grids to create chains 8 and fields 9.

The game is played by having every pawn 5 on the grid connected to the center cross piece 7 either directly, or through a chain 8 of pawns 5 and connectors 6. Each player must first place a pawn piece followed by a chosen connector, unless the pawn joins two open ends of connectors 6 that are already on the board 2.

Each pawn 5 can be added either to the player's own or to the opponent's connector 6. If a player creates a field 9 than all of the pawns 5 of each of the eligible opponents are located inside that field 9 and are removed and returned to each owner to be used again. A player creates a "field" 9 by enclosing a path over an area, then all the opponent's pawns 5 within this field 9 are removed and returned to the owner. Those pawns 5 which can be removed and returned to the owner are those that do not break the connection with the center cross piece 7. However all the connectors 6 at the end of the pawns 5 inside the field 9 must remain in place. The returned pawns 5 must be reused. Only the player who has created the field can continue to place his pawns 5 inside the field 9, thus limiting the space available on the board 2 for an opponent to place his pawns 5.

The game is played in two phases, a run phase and a finish phase. The run phase is played as described above. The player selected to go first initiates the game 1 by placing a pawn 5 next to one of the four paths determined by the four legs 10 of the cross piece 7 located in the center of the game board 2. The first player then places one of his pawns 5 in the game board 2 either next to one of the remaining legs 10 of the centrally located cross piece 7 or next to one of the legs 11 of the connector 6 that the first player had placed in the game board 2. Thus second player then places a connector 6 of his choice next to the pawn 5 he has inserted into the game board 2 and the game 1 continues on in this fashion in sequence with each player placing a pawn 5 near a leg 11 of a connector 6 or the original centrally located crosspiece 7 followed by placement on the other side of the pawn 5 with the insertion into the game board 2 of a connector 6. The run phase of the game 1 concludes when a player cannot make a move either because he has used up all his connectors 6 or no available connectors 6 can be played or there are no open ends available. If the other opponent cannot make the move either, the game is concluded, and the player with the fewest pawns 5 wins. In the case of a tie, the player with the last move wins. The finish phase of the game begins if an opponent can make a move.

During the finish phase of the game, a player with the right to move continues to place his pawns 5 until available possibilities are exhausted. All the previously mentioned rules are still valid. The opponent can not now return to the game even if a new configuration would permit the opponent to move along the game board. At the end, the player with the fewest pawns 5 on hand wins. In the case of a tie, the player who played the finish wins.

The game permits players to form any of the following strategies or tactics:

1. Creating change to get rid of the pawns 5 on hand;
2. Creating fields of closed chains 8 of the same color;
3. Forcing the opponent into a chosen path;
4. Blocking the opponent's path;
5. Striking the opponent's pawns.

The game board itself can be made of any materials, including wood or plastic. Similarly, the pieces can be made of plastic or wood materials, as well as many other convenient materials.

I do not limit myself to any particular materials of construction set forth in specification and illustration in the accompanying drawings, as the same refers to and sets forth all the certain embodiments of the invention, and the same may be modified without departing from the spirit and scope of the claimed invention.

Having thus described the invention, what is secured by Letters Patent is as follows:

1. A method of playing a game including a game board and playing pieces, the steps comprising:

providing by having a game board formed of raised squares; inserting playing pieces within recesses defined in between said raised squares, said game board having a center including a cross piece having four legs within the recesses of the center of said game board; defining four paths originating from said four legs of said cross piece from which the game is initiated; and further providing sets of playing pieces including pawns and connectors;

determining paths from a number of legs of said connectors which can be followed by players during the game;

said connectors each having at least one leg which is placed next to a pawn in said game board and at least one additional leg defining a further path for a player to follow by placing a pawn next to said at least one adjacent leg of said connector and said pawns having one end to be located on said game board next to either one of said legs of a connector or next to one of said legs of said centrally located cross piece and having another end next to which a connector is placed wherein each player receives one set of playing pieces;

initiating the game by having a selected first player place one end of a pawn next to one of said four legs of said centrally located cross piece and then placing a connector next to another end of said pawn in order to form a chain of pawns and connectors in a path;

continuing the game by having another player place a pawn next to a leg of a connector inserted in the game board or of said cross piece; and continuing to play in turn with each player exhausting his pawns so that the player with the fewest pawns wins the game wherein the game concludes when one player first exhausts his entire supply of pawns or when no further movement on the game board is possible.

2. The method of playing a game according to claim 1 further comprising the step continuing the game further includes having a player encircling pawns and connectors on the game board with other chain of connectors and pawns from a same set and removing all the players pawns from within thereby creating a field and only the player creating the field can continue to place his pawns within said field.

3. The method according to claim 2 wherein the connectors within said field remain on the game board.

4. The method according to claim 1 wherein a player can create certain chains on said game board in order to eliminate as many of his pawns from his possession.

5. The method according to claim 1 wherein each player is at the beginning of the game given pawns of a particular color and no player has the same colored pawns as any other player.

6. The method according to claim 5 wherein each player can create a field of forming a closed chain containing only his own colored pawns.

7. The method according to claim 1 wherein each player can create a field by forming a closed chain containing only his pawns wherein a player places his pawns and connectors on said board in a manner to limit an opponent's ability to place his pawns and connectors on said board and thus force his opponent into certain pathe son said board.

8. The method according to claim 1 wherein a player can place his pawns on said game board to block an opponent's path.

9. The method according to claim 1 wherein a player can place his pawns on said game board to remove an opponent's pawns.

10. A game comprising:

A game board formed of raised squares, said raised squares defining recesses therebetween;

playing pieces which can be inserted in said recesses of said raised squares, said playing pieces defining paths that a player can take;

said playing pieces including pawns and connectors, said connectors each having at least one leg defining a further path for placement of a next pawn, said recesses each having a side with a length substantially equal to a length of one of said pawns and a length of two legs of one of said connectors;

said game board having a center portion defined by some of said recesses;

a cross-shaped piece adapted to be disposed in some of said recesses in said center portion of said game board, said cross-shaped piece having four legs defining four possible starting paths for a player to move on said game board;

said connectors each having at least one leg which is placed next to a pawn in said game board and at least one additional leg defining a further path for a player to follow by placing a pawn next to said at least one additional leg of said connector and said pawns having one end to be located on said game board next to either one of said legs of a connector or next to one of said legs of said centrally located cross piece and having another end next to which a connector is placed wherein each player receives one set of playing pieces.

11. The game according to claim 10 wherein includes connectors and pawns.

12. The game according to claim 11 wherein said pawns are rectangularly shaped.

13. The game according to claim 12 wherein said connectors are formed of various shapes.

14. The game according to claim 13 wherein at least some of said connectors are T-shaped.

15. The game according to claim 13 wherein at least some of said connectors are L-shaped.

16. The game according to claim 13 wherein at least some of said connectors are I-shaped.

17. The game according to claim 13 wherein at least some of said connectors are X-shaped.

18. The game according to claim 10 wherein said game board has a center portion and said center portion has an X-shaped piece in the recesses of said center portion to define starting paths for player from any of four legs of said X-shaped piece.

19. The game according to claim 10 further comprising sets of game pieces for two players wherein each set of game pieces includes 52 pawns, 3 cross-shaped connectors, 6 I-shaped connectors, 12 L-shaped connectors, and 18 T-shaped connectors.

* * * * *